US006079572A

United States Patent [19]

Irvin

[11] Patent Number: 6,079,572

[45] Date of Patent: Jun. 27, 2000

[54] IN-LINE SKATE WHEEL RACK AND CARRYING DEVICE

[76] Inventor: Patricia N. Irvin, 7517 Standard, Centerline, Mich. 48015

[21] Appl. No.: 09/002,798

[22] Filed: Jan. 6, 1998

Related U.S. Application Data

[60] Provisional application No. 60/034,999, Jan. 7, 1997.

[51] Int. Cl.[7] ..... A47F 7/04

[52] U.S. Cl. ..... 211/23; 211/59.1; 211/85.5; 211/85.7; 312/42; 312/118

[58] Field of Search ..... 211/23, 59.1, 85.7, 211/85.5, 171, 170, 74, 68, 70.2; 312/318, 42, 118; 206/558; 221/97

[56] References Cited

U.S. PATENT DOCUMENTS

| | | | |
|---|---|---|---|
| 112,272 | 2/1871 | Norris | 221/97 X |
| 269,346 | 12/1882 | Stoffel | 221/97 X |
| D. 320,325 | 10/1991 | Barfield | D6/552 |
| 473,080 | 4/1892 | Pierre | 211/59.1 |
| 486,640 | 11/1892 | Gingras | 211/59.1 |
| 543,657 | 7/1895 | Rosenberg | 312/118 |
| 764,529 | 7/1904 | Ingalls | 312/118 |
| 777,895 | 12/1904 | Geraci | 312/118 |
| 846,741 | 3/1907 | Fraser | 211/97 |
| 1,059,561 | 4/1913 | Parks | 206/558 X |
| 1,066,555 | 7/1913 | Treiber | 211/68 |
| 1,174,185 | 3/1916 | Scott | 211/68 |
| 1,313,865 | 8/1919 | Hahn | 312/118 |
| 1,328,185 | 1/1920 | Morton | 312/118 |
| 1,432,330 | 10/1922 | Gross | 221/118 |
| 1,508,239 | 9/1924 | O'Brien | 211/59.1 |
| 1,561,201 | 11/1925 | Wocel et al. | 211/59.1 |
| 1,866,511 | 7/1932 | McKee et al. | 312/118 |
| 1,930,076 | 10/1933 | Bentley | 211/85.5 X |
| 2,398,896 | 4/1946 | Simmons et al. | 211/59.1 X |
| 2,588,529 | 3/1952 | Hume | 211/59.1 X |
| 2,645,353 | 7/1953 | Anderson, Jr. | 211/70.2 |
| 2,670,085 | 2/1954 | Sorrentino | 211/59.1 |
| 2,681,262 | 6/1954 | Vincent | 312/118 |
| 3,266,688 | 8/1966 | Sefton | 211/59.1 X |
| 3,305,190 | 2/1967 | Gans | 211/59.1 X |
| 3,700,113 | 10/1972 | Hager | 211/23 |
| 3,948,396 | 4/1976 | Upton et al. | 211/59.1 |
| 4,305,628 | 12/1981 | Glasener | 312/118 X |
| 4,367,819 | 1/1983 | Lewis | 211/59.1 |
| 4,561,705 | 12/1985 | Schafer | 312/118 X |
| 4,929,427 | 5/1990 | Guala | 211/74 X |
| 5,377,849 | 1/1995 | Martin | 211/13 |
| 5,399,214 | 3/1995 | Wenschhof et al. | 211/13 X |
| 5,496,103 | 3/1996 | Kozark | 312/118 |

*Primary Examiner*—Daniel P. Stodola
*Assistant Examiner*—Khoa Tran
*Attorney, Agent, or Firm*—Weintraub & Brady, P.C.

[57] ABSTRACT

A rack for removably mounting in-line skate wheels includes a top plate having a retainer for releasably locking a wheel-mounting spindle thereto. The spindle is rotatably secure to the rack. Preferably, a plurality of spindles are deplayed. The rack may be incorporated into a multi-compartment framing which includes shelves and at least one drawer. By enveloping the rack within a suitable covering, a carry-all or carrying bag or case is provided.

5 Claims, 2 Drawing Sheets

FIG 1
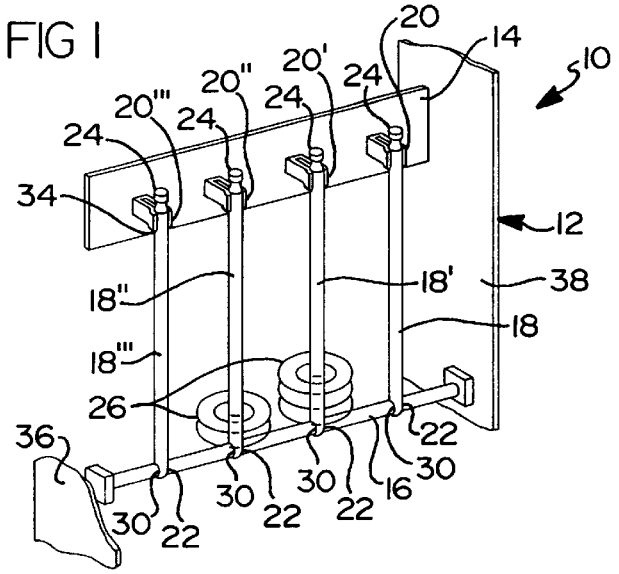
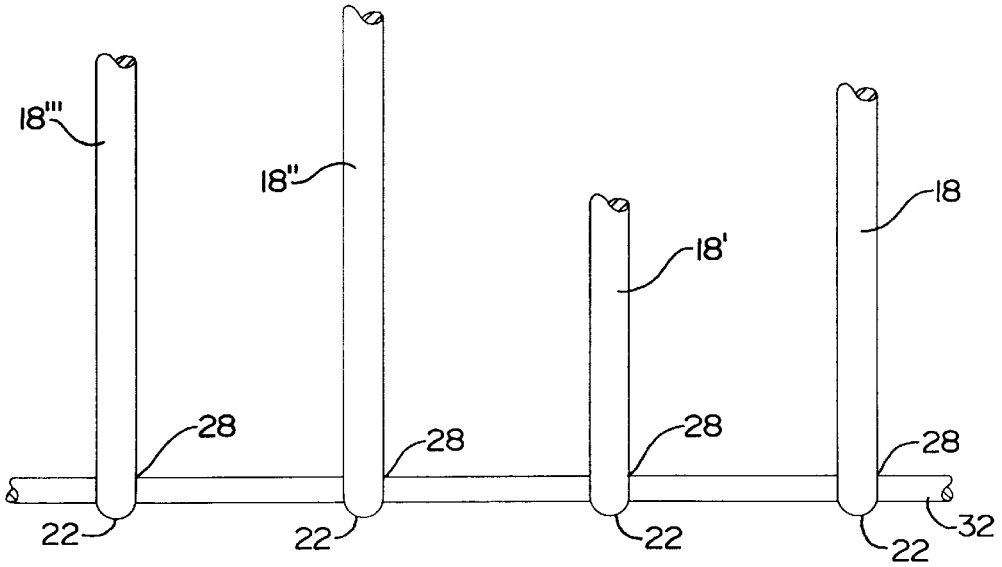
FIG 2

FIG 3
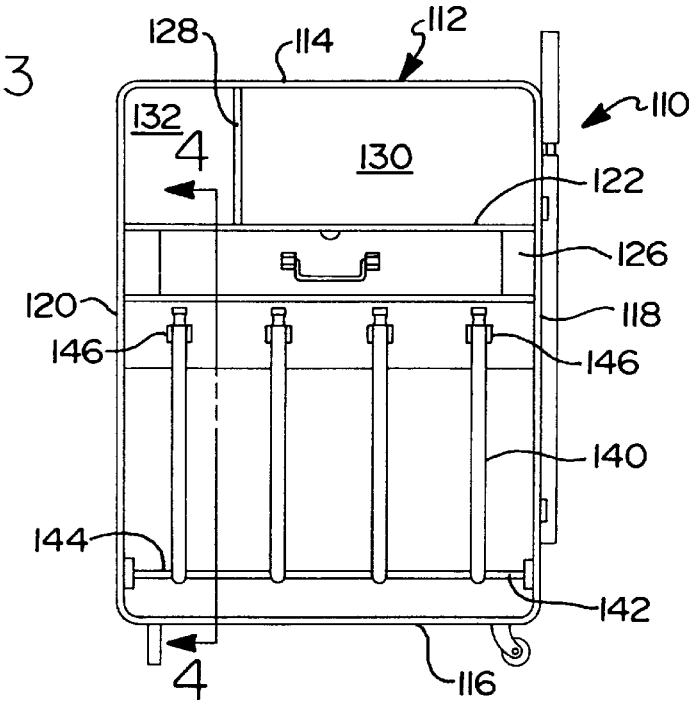
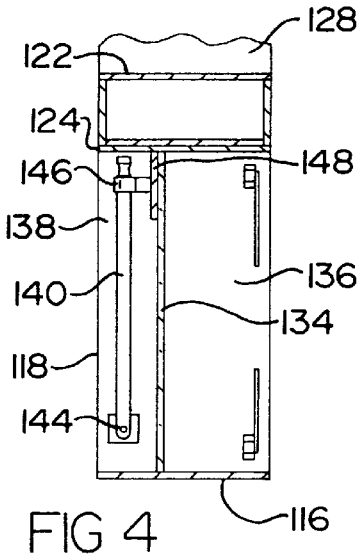
FIG 4
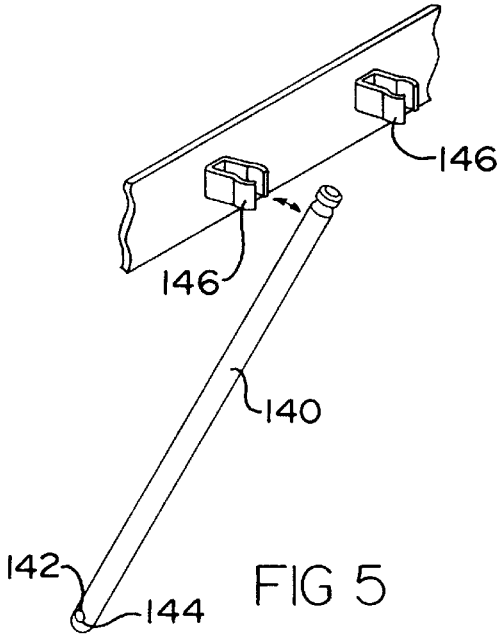
FIG 5

IN-LINE SKATE WHEEL RACK AND CARRYING DEVICE

CROSS REFERENCE TO RELATED APPLICATIONS

This application is a completion application of copending provisional application Ser. No. 60/034,999, filed Jan. 7, 1997, the disclosure of which is hereby incorporated by reference.

STATEMENT REGARDING FEDERALLY SPONSORED RESEARCH OR DEVELOPMENT

Not Applicable.

STATEMENT REGARDING MICROFICHE APPENDIX

Not Applicable.

BACKGROUND OF THE INVENTION

1. Field of the invention

The present invention pertains to carrying devices.

More particularly, the present invention pertains to gymnasium bags for carrying athletic paraphernalia. Even more particularly, the present invention pertains to bags of the type which are used to carrying in-line skates and the like.

2. Prior Art

At the outset, and as is known to those skilled in the art to which the present invention pertains, one of the latest rages in sports is "in-line" skating. In-line skating, as both a recreational and competitive sport, involves the wearing of a boot or shoe, the bottom of which has mounted thereonto a plurality of rotatable discs or wheels which are co-axially aligned and which are rotated as the wearer traverses a horizontal surface to propel the wearer therealong. In essence, in-line skating may be deemed or defined as a type of non-ice surface skating. In order to accommodate different terrain, there is provided different types of wheels. The wheels, themselves, are removably mountable to the boot and, thus, are interchangeable. Likewise, there are different sizes and different materials used for the wheels which are available to the user. Typically, in toting skates and wheels the user merely puts the in-line skates as well as the various wheels in a random and haphazard manner within a carrying bag. There simply is no order to the manner of toting the wheels. To alleviate this situation the present invention, as detailed hereinafter, provides a rack as well as a carrying bag or case, incorporating the rack, for facilitating the transport of in-line skates and the wheels associated therewith.

The present device as described hereinafter is distinct from prior art racks. For example, U.S. Pat. No. 5,377,849, which teaches a rack specifically adapted for football and hockey equipment, e.g., gloves, shoulder pads, etc., is representative of such prior art devices, i.e., adopted for specific sports. Here, and as noted above, the present device provides a "carry-all" for the entirety of in-line skating needs.

SUMMARY OF THE INVENTION

In accordance herewith, there is provided a carrying device which accommodates in-line skate wheels as well as being capable of transporting in-line skating accessories, tools, as well as the skates themselves.

In a first aspect hereof, there is defined a rack for transporting in-line skate wheels which, generally, comprises:

(a) a first top plate, (b) at least one in-line skate wheel mounting spindle, the spindle having a first end and a second end, the first end being rotatably secured to the rack at one end thereof; and (c) a retainer for releasably retaining the other end of the spindle to the top plate.

In a second aspect hereof, the rack is incorporated into a compartmented frame and including at least one drawer. The compartmented frame, also, accommodates the skates themselves.

The frame may be enveloped by a cloth material to define a carrying case. Similarly, the carrying case may be equipped with transport wheels and handles.

For a more complete understanding of the present invention, reference is made to the following detailed description and accompanying drawing. In the drawing, like reference characters refer to like parts throughout the several views, in which:

BRIEF DESCRIPTION OF THE DRAWING

FIG. 1 is perspective view of a carrying device in accordance with the present invention;

FIG. 2 is a side elevational view of an in-line skate wheel rack used with the carrying device hereof and in accordance with the present invention;

FIG. 3 is a front elevational view of an in-line skate carrying rack incorporated as a piece of luggage in accordance with the present invention;

FIG. 4 is a cross-sectional view taken along line 4—4 of FIG. 3; and FIG. 5 is a broken perspective view showing the interconnection between the spindles and the keeper.

DESCRIPTION OF THE PREFERRED EMBODIMENT

Now, and with reference to the drawings, and in particular, FIGS. 1 and 2, the present invention, as is depicted in the drawing, is shown as generally comprising a rack which includes:

(a) a first top plate;

(b) at least one wheel mounting spindle having a first end and a second end which is rotatably mounted to the rack at a first end thereof; and (c) a retainer for removably locking the spindle at the second end thereof, the retainer being disposed on the top plate.

With more particularity, and as shown in the drawing the present rack, generally denoted at 10, is defined by a frame 12 which includes a first or top plate or brace 14. Optimally, the rack includes a second or bottom plate or brace 16. The plate 16 defines a mounting base for the at least one and, preferably, a plurality of wheel mounting spindles 18, 18' etc. The top plate includes the retainer or keeper 20, 20', etc. for temporarily locking an associated spindle in place.

The present rack includes at least one and, preferably, a plurality of spaced apart elongated rods or spindles, as shown. The space provided between adjacent spindles is sufficient to provide clearance for in-line skate wheels 26 which are stacked or mounted on the spindles in a manner to be described subsequently. Each spindle 18, 18', 18" has a first end 22 and a second end 24. In a first embodiment hereof, the first end of each spindle is rotatably mounted to the base plate 16.

As shown in FIG. 1, each spindle 18, 18', 18" has an opening or bore 28 formed therethrough proximate the first end 22. A pivot pin 30 or the like projects through the bore 28 and is secured to the base plate 16, as shown. In this manner, each spindle is rotatable about the pin, as shown.

Alternatively, as shown in FIG. 2 and as detailed below, a rod 32 or axle may be inserted through the bore 28 of each spindle 18, 18', etc., to enable each spindle to rotate thereabout. It is to be appreciated that the focus hereof is that the spindle be rotatable about a base member.

The top plate or brace 14 includes at least one keeper 20, and preferably a plurality of keepers 20', 20" for temporarily retaining, in locked position, the second end 24 of each spindle. There is one keeper associated with each spindle.

Each keeper or retainer may comprise any suitable means such as a recess 34 or cut-out portion formed in the plate 14 and of suitable dimension to enable the second end 24 of each spindle to be frictionally retained therein. Alternatively, and although not shown, the cut-out portion may have a rubber grommet or the like disposed or otherwise secured within the cut-out portion which envelops and encircles the second end of the spindle and frictionally retains it therein. By applying sufficient rotational pressure against the second end it can be removed from the cut-out portion. Similarly, and as described below, each keeper may comprise a flexible member which compressively holds the spindle in place.

In defining the rack 10 hereof, spaced apart framing braces 36 and 38 extend between the base plate and top plate at the extremities thereof and are secured thereto by any suitable means, such as welding, threaded fasteners or the like. The framing braces cooperate with the top and base plates to provide a substantially rectangular structure. As shown in FIG. 2, the axle 32 extends between the framing braces 36 and is secured therebetween by having one end of the axle connected to one brace 36 or 38 and the other end of the axle secured to the other framing brace.

It is to be appreciated by those of ordinary skill in the art to which the present invention pertains that a plurality of in-line skate wheels 26 can be mounted onto the various spindles. As is known to the skilled artisan each In-line skate wheel has a central opening or bore which, when in use, has a skate axle extending therethrough. This central opening is used for mounting the wheel onto a spindle. Here the opening is dimensioned such that it can be journalled onto the spindle and removably emplaced thereon. By placing the various sizes of wheels on the spindles the wheels may be maintained in an orderly fashion within an athletic bag or other suitable tote.

Thus, and in accordance with another aspect of the present invention, there is provided a carrying bag, such as an athletic or gym bag or other type of "carry-all" having the present rack disposed therewithin. Preferably, the rack is permanently affixed therewithin such as by sewing suitable material around the rack and allying it to the bag itself. Typically, such bags have a bottom wall, a pair of opposed side walls and an access through at least one wall, such as by a zipper or the like. By orientating the rack in appropriate fashion, the spindles may be accessed through the opening and rotated in such a manner that the wheels may be mounted thereonto.

The exact configuration of the carrying bag is not critical hereto but that the rack may be disposed therewithin. The carrying bag may be provided with suitable compartments, one of which stores the rack, one of which stores the skates and so forth. Such a bag is within the scope hereof.

A particularly preferred configuration for a combined rack and carrying device is depicted in FIGS. 3–5 where there is shown an in-line skate carrying device contemplated by the present invention and, generally, denoted at 110. The device hereof may be cloth covered and have travel wheels attached thereto, as well as an extensible handle, which elements are not shown herein for purposes of clarity. However, the incorporation of travel wheels as well as extensible handles and carrying handles is well within the ability of the skilled artisan.

As shown in the drawing, the carrying device 110 contemplates a frame 112 having an upper wall 114, a lower wall 116 and spaced apart side walls 118, 120. The device further includes a pair of parallel spaced apart transverse walls 122, 124 which define a space therebetween. A drawer 126 is slidably positioned and disposed in the space defined between the medial walls 122, 124 and the side walls 118, 120, as shown. The drawer 126 is provided to retain necessary tooling for changing in-line skate wheels as well as any other tools or accessories necessary to an in-line skater.

A partition 128 extends between the top wall 114 and the transverse wall 122 and is normal thereto. The partition 128 defines the frame 112 into upper shelves 130 and 132, The shelves may be used to stow a helmet, gloves, and the like.

A second partition 134 extends between the lower medial wall 124 and the bottom wall 116 and is normal thereto. The partition 134 serves to provide compartments 136 and 138, as shown. The compartment 138 is used to mount the in-line skate wheels and to stow them therewithin in the manner heretofore described. The compartment 136 is used to stow the skates themselves and are retained therewithin by a suitable retainer, such as an extensible cord commonly known as a "bungee" cord which traverses the compartment.

Herein, and as shown, the spindles 140 are pivotally rotatably mounted on a rod or pivot pin 142 which traverses the width of the device 110 proximate the lower wall 116 and is secured to the side walls 118, 120 by any suitable means. The spindles, themselves, have a suitable aperture or throughbore 144 formed therethrough through which the rod 142 projects to pivotally or rotatably mount the spindles thereonto. A C-shaped or U-shaped keeper or retainer 146 formed from any suitable flexible material, such as a plastic or the like is used to frictionally retain the free end of an associated spindle in the manner heretofore described by pushing the second of the spindle therepast. Typically, the legs of the keeper may be longer than the diameter of the second end so that the spindle end is trapped by the legs of the keeper. Ultimately, the legs of the keeper may have opposed patterns formed therein which define a seat for the end of the spindle. Because the diameter of the seat is less than the diameter of the spindle end, the legs of the keeper compress against the spindle to retain it in position. The flexibility of the keeper enable easy release therefrom.

Herein, a plate 148 is secured to the partition 134 and is vertically axially spaced from the rod 142. The keepers 146 are mounted onto the plate 148 and are retained thereon, as shown.

Thus, the device 110 provides a total carrying device which accommodates all of the necessary accoutrements used by an in-line skater as well as providing a rack for easily mounting the wheels thereonto.

It is to be appreciated that the present invention facilitate the orderly maintenance of in-line skate wheel while being carried within a suitable carrying bag.

Having thus described the invention, what is to be claimed is:

I claim:

1. A rack for removably mounting an in-line skate wheel, comprising:

(a) a top plate, (b) a base plate spaced apart and below the top plate (c) at least one spindle for removably mounting an in-line skate wheel thereon, the spindle having a first end associated with the top plate and a second end associated with the base plate, the spindle being pivotably mounted to the rack, (d) at least one retainer for releasably locking the spindle to the rack at the first end thereof, the retainer being connected to the top plate, (e) a first medial wall, (f) a first partition extending between and disposed medially of the first medial wall and the base plate, the at least one spindle being disposed on one side of the upstanding partition, (g) a second medial wall overlying and spaced apart from the first medial wall, a space being defined between the medial walls, a drawer being disposed in the space, (h) a top wall overlying and vertically spaced apart from the drawer, and (i) a second partition extending between the top wall and the second medial wall and normal to the first partition.

2. The rack of claim 1 wherein:

the at least one spindle has a bore formed therethrough, the rack further comprising:

a pivot pin fixed to the base plate and extending through the throughbore and cooperating therewith to pivotably mount the at least one spindle to the base plate.

3. The rack of claim 1 which further comprises:

a pair of spaced apart side walls, the top plate extending therebetween, a rod extending between the side walls, the at least one spindle having a throughbore formed therethrough, the rod projecting through the throughbore to pivotably mount the spindle to the rack.

4. The rack of claim 1 which further comprises:

(a) a plurality of spindles disposed on the one side of the partition, and (b) a plurality of retainers, one retainer being associated with one spindle.

5. A carrying case which comprises:

(a) an exterior covering; and (b) an in-line skate wheel rack disposed within the covering, the rack comprising the rack of claim 1 the covering corresponding to the shape of the rack thereof.

* * * * *